US005876074A

United States Patent [19]

Dowling

[11] Patent Number: 5,876,074

[45] Date of Patent: Mar. 2, 1999

[54] LATCH DEVICE FOR A VEHICLE BACK

[75] Inventor: Patrick J. Dowling, Yamanashi-ken, Japan

[73] Assignee: Mitsui Kinzoku Kogyo Kabushiki Kaisha, Tokyo, Japan

[21] Appl. No.: 971,580

[22] Filed: Nov. 17, 1997

[51] Int. Cl.[6] ..... E05C 3/06

[52] U.S. Cl. ..... 292/201; 292/216; 292/341.16; 292/DIG. 23; 292/DIG. 43

[58] Field of Search ..... 292/196, 201, 292/216, 336.3, 341.16, DIG. 23, DIG. 43

[56] References Cited

U.S. PATENT DOCUMENTS

| | | | |
|---|---|---|---|
| 4,762,348 | 8/1988 | Matsumoto | 292/201 |
| 4,968,074 | 11/1990 | Yamagishi et al. | 292/216 |
| 5,273,324 | 12/1993 | Kubayashi | 292/201 |
| 5,288,115 | 2/1994 | Inoue et al. | 292/216 |
| 5,454,607 | 10/1995 | Ishihara et al. | 292/201 |
| 5,618,068 | 4/1997 | Mitsui et al. | 292/201 |
| 5,632,515 | 5/1997 | Dowling | 292/DIG. 43 |

*Primary Examiner*—Steven Meyers
*Assistant Examiner*—Teri Pham
*Attorney, Agent, or Firm*—Browdy and Neimark

[57] ABSTRACT

A vehicle door latch device comprises a latch assembly fixed to a vehicle back door and a motorized closure assembly attached to the latch assembly. The latch assembly includes a housing, a latch accommodated in the housing by a latch shaft, and a ratchet accomodated in the housing by a ratchet shaft. The motorized closure assembly has an electric motor and a rotating lever for displacing the latch from a half-latched position to a full-latched position. The latch has a latch arm which substantially extends toward an outer panel of the door and overlaps with a rotating locus of the rotating lever.

10 Claims, 5 Drawing Sheets

FIG. 4
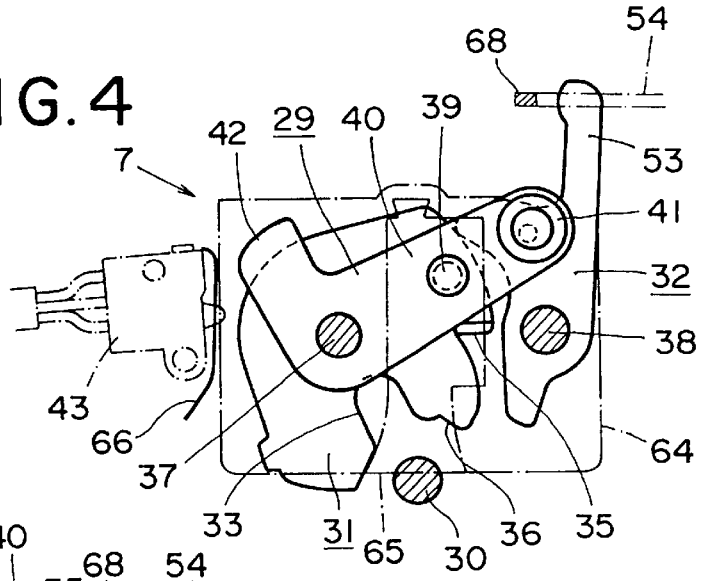
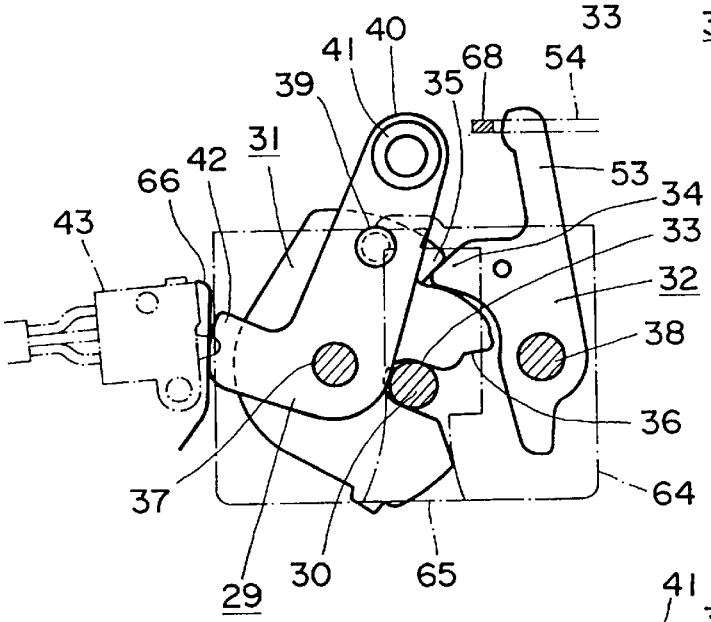
FIG. 5
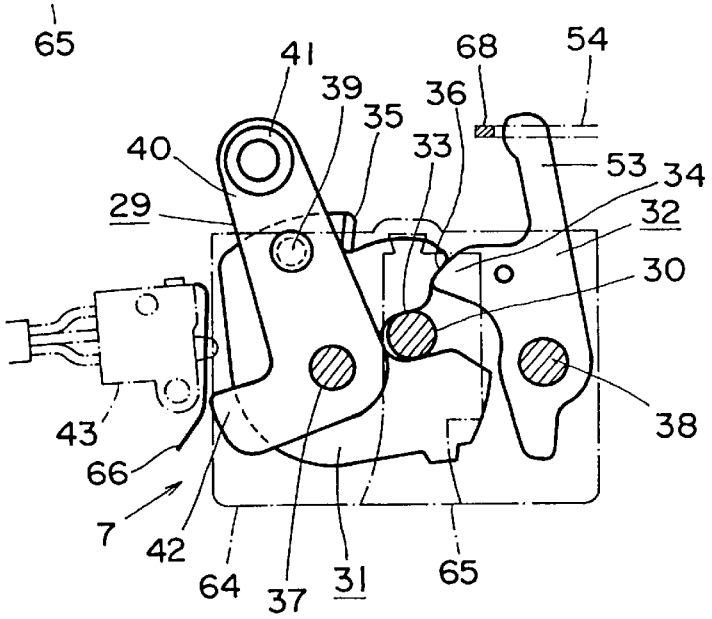
FIG. 6

LATCH DEVICE FOR A VEHICLE BACK

BACKGROUND OF THE INVENTION

The present invention relates to a latch device for a vehicle door with a motorized closure assembly, and particularly relates to a compact latch device suitably used in a vehicle back door.

U.S. Pat. No. 5,520,425 conventionally proposes a latch device for a vehicle door which comprises a latch assembly holding a vehicle door in a closed state by engaging with a striker fixed to a vehicle body, and a motorized closure assembly displacing the latch assembly into a full-latched state from a half-latched state so as to close the door completely.

The above prior art motorized closure assembly is designed so as to be arranged in a place separated from the latch assembly, so that it is unsuitable for use in a back door which has a narrow attaching space.

U.S. Pat. No. 4,986,579 describes a latch device of a vehicle door having an outer panel and an inner panel. This prior art latch device has a latch assembly (A) which is fixed to an end portion of the door and has a latch (7) engageable with a striker (81) fixed to a vehicle body and a ratchet (15) for holding the engagement between the latch (7) and the striker (81) by engaging with the latch (7); said latch (7) being rotated against a resilient force of a spring (9) from a door-opening position to a full-latched position through a half-latched position by engaging with the striker (81); said latch (7) being supported by a latch shaft (8); said ratchet (15) being supported by a ratchet shaft (16) parallel to the latch shaft (8); a motorized closure assembly (40) which is attached to the door in proximity to the latch assembly (A) and has an electric motor (43), an output member (57) rotated by the electric motor (43), a rotating lever (58) for rotating the latch (7) from the half-latched position to the full-latched position when rotated, and a connecting member (59) displaceable between a connecting position where rotation of the output member (57) can be transmitted to the rotating lever (58) and disconnecting position where the rotation of the output member (57) cannot be transmitted to the rotating lever (58); a switch (49) for detecting the half-latched position of the latch (7) so as to operate the motor (43); a spring (65) for biasing the connecting member (59) toward the connecting position; a fail-safe lever (60) displacing the connecting member (59) into the disconnecting position against the resilient force of the spring (65) when rotated; said latch (7) having a latch arm (20) which extends toward the inner panel and is overlapped with a rotating locus of the rotating lever (58) when the latch (7) is located in the half-latched position; and said ratchet (15) having a ratchet arm (24) which extends toward the inner panel.

The latter latch device has a disadvantage in that the latch arm (20) and the ratchet arm (24) extend toward the inner panel of the door. In the latch assembly, interior and exterior sides of the latch assembly are defined by the position of an opening portion into which the striker enters when the door is closed, which opening portion must be formed on the interior side of the latch assembly at any time. Further, the distances between the opening portion and the latch shaft or the ratchet shaft should be reduced as much as possible to compactly form the latch assembly. Therefore, it is impossible to increase lengths of the latch arm (20) and the ratchet arm (24) which extend toward the inner panel of the door, thereby large rotating torque is required to rotate the latch (7) toward the full-latched position from the half-latched position by a contact of the rotating lever (58) and the latch arm (20), and the motorized closure assembly (40) is large-sized. Similarly, large force is also required when the ratchet arm (24) is rotated.

Further, the latch device in the latter well-known example also has another disadvantage in that the motor (43) is greatly projected to the interior side of the latch assembly.

SUMMARY OF THE INVENTION

Accordingly, an object of the present invention is to provide a compact latch device with a motorized closure assembly suitably used in a back door which has a narrow attaching space.

BRIEF DESCRIPTION OF THE DRAWINGS

FIG. 4 is a plan view showing a latch assembly of the latch device in a door-opening state;

FIG. 5 is a plan view showing the latch assembly in a half-latched state;

FIG. 6 is a plan view showing the latch assembly in a full-latched state;

DETAILED DESCRIPTION OF THE PREFERRED EMBODIMENTS

Figure 1:
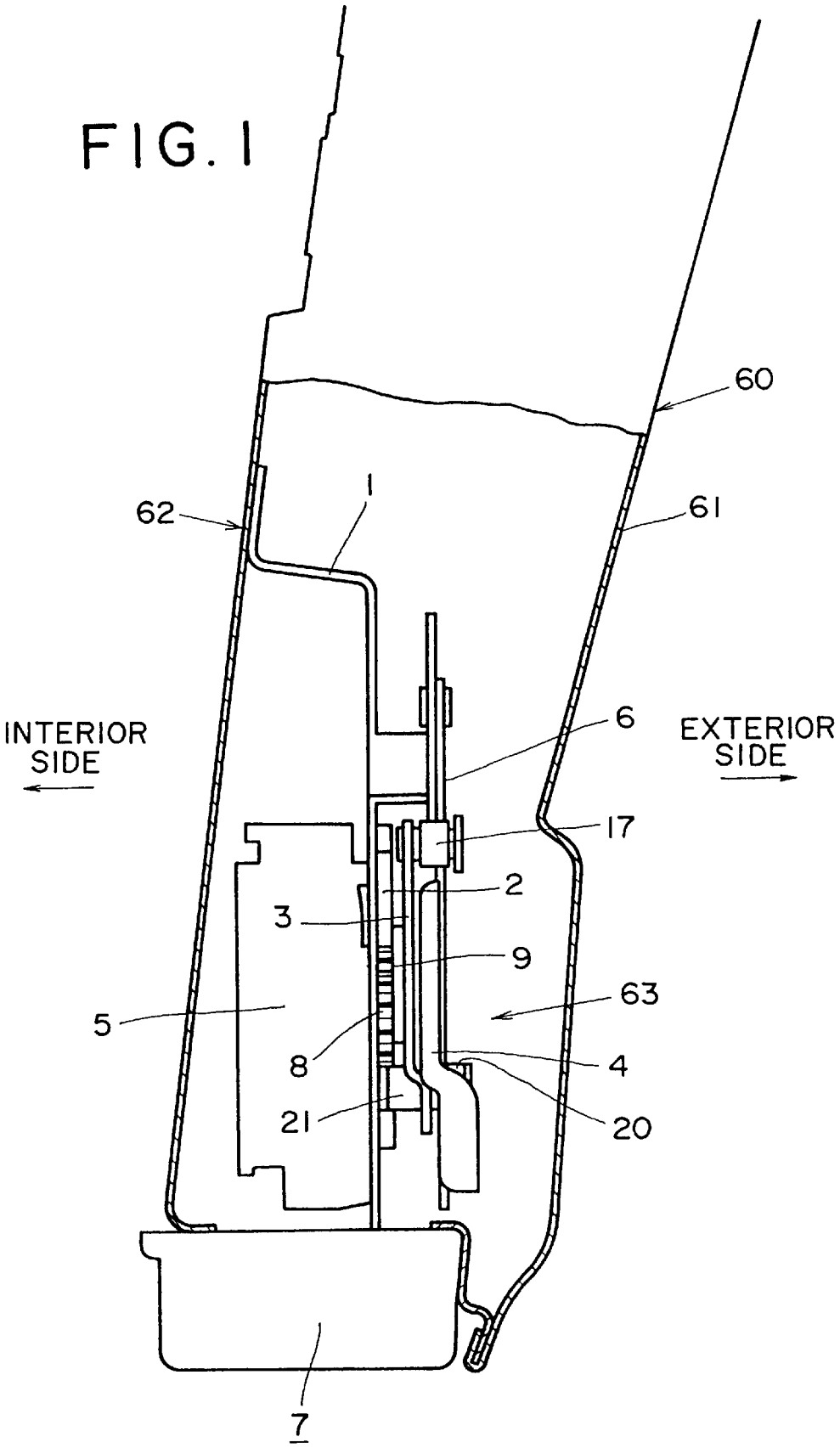
FIG. 1 is a partially longitudinal sectional view showing a latch device of the present invention attached to a back door.

One embodiment of the present invention will next be described with reference to the drawings. As shown in FIG. 1, a latch device according to the present invention is fixed to a trunk lid or a back door 60 of a vehicle which has an outer door panel 61 opposed to an exterior side of the door 60 and an inner door panel 62 opposed to an interior side of the door 60. The latch device has a latch assembly 7 which holds the back door 60 in a closing state in cooperation with a striker 30 fixed to a vehicle body, and a motorized closure assembly 63 which displaces the latch assembly 7 from a half-latched state to a full-latched state.

The latch assembly 7 has a latch 31 which is engageable with the striker 30, and a ratchet 32 which holds the engagement of the latch 31 and the striker 30 by engaging with the latch 31. The latch 31 and the ratchet 32 are respectively rotatably stored into a housing 64 of the latch assembly 7 by a latch shaft 37 and a ratchet shaft 38. At an interior side of the housing 64 is formed an opening portion 65 into which the striker 30 enters when the door 60 is closed.

Figure 2:
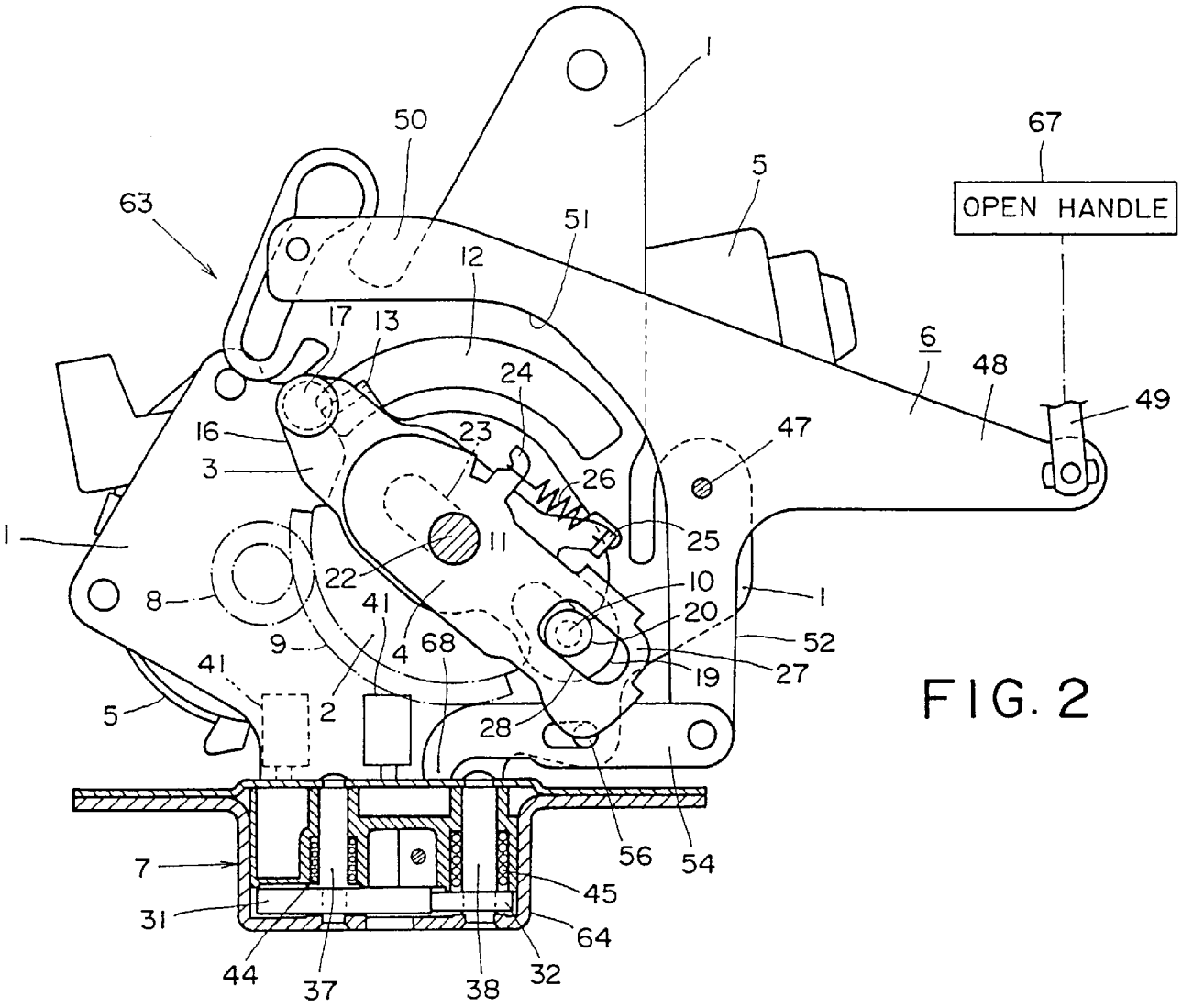
FIG. 2 is a partial sectional view showing an exterior side of the latch device.
Figure 3:
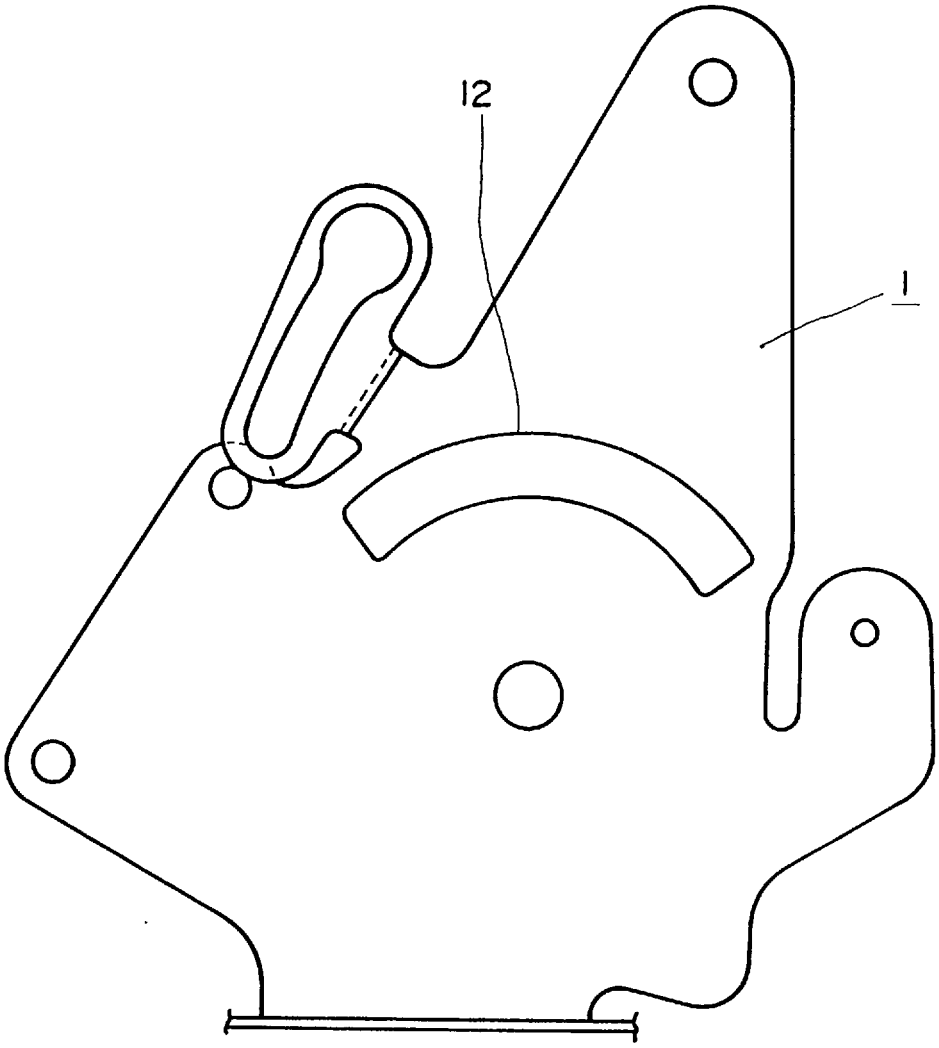
FIG. 3 is a front view of a bracket of a motorized closure assembly of the latch device.
Figure 7:
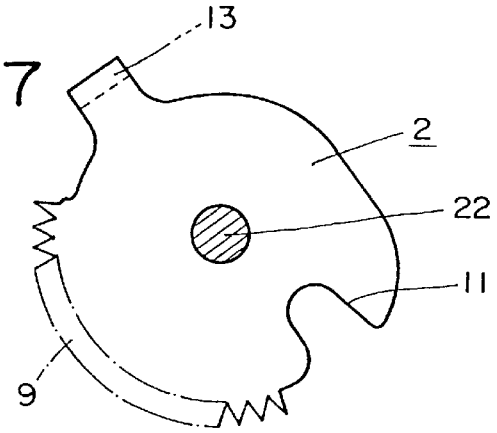
FIG. 7 is a front view of an output member of the motorized closure assembly.
Figure 8:
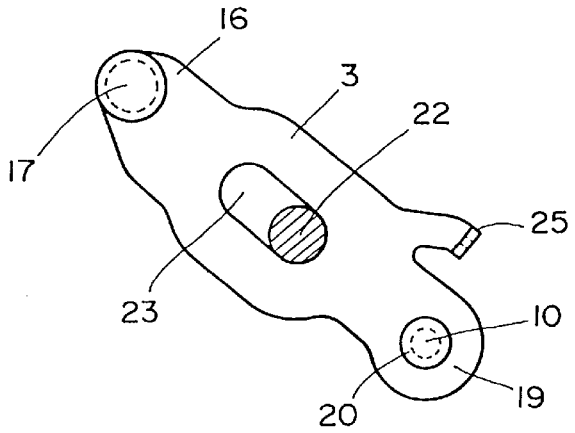
FIG. 8 is a front view of a connecting link of the motorized closure assembly.
Figure 9:
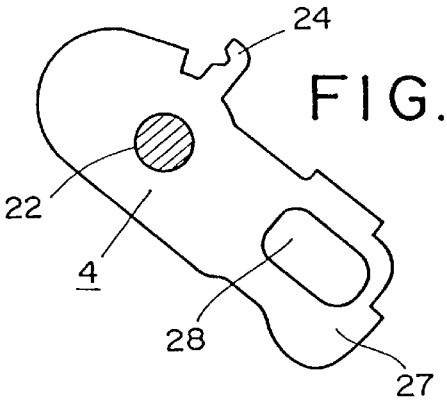
FIG. 9 is a front view of a rotating lever of the motorized closure assembly.
Figure 10:
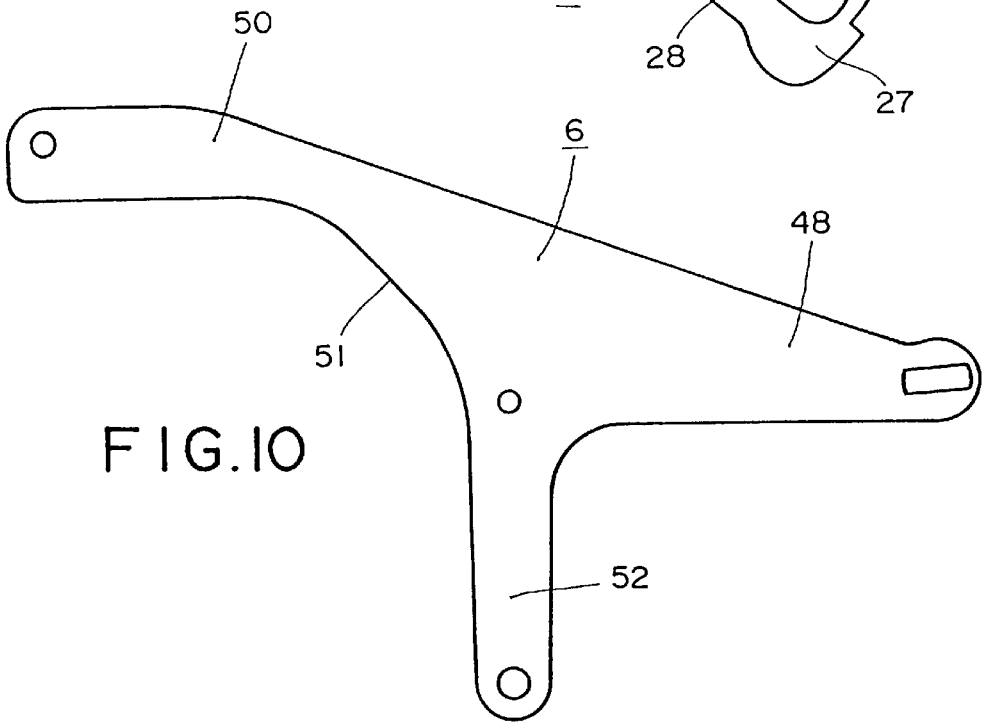
FIG. 10 a front view of a fail-safe lever of the motorized closure assembly.

In FIGS. 4 to 6, the latch 31 is biased clockwise by a resilient force of a spring 44 (see FIG. 2), and is held in a door-opening position shown in FIG. 4 when the back door 60 is opened. The ratchet 32 is biased counterclockwise by a resilient force of a spring 45 (see FIG. 2). When the door 60 is closed, the striker 30 enters into the opening portion 65 of the housing 64 and engages with a U-shaped groove 33 of the latch 31 so as to rotate the latch 31 in a counterclockwise direction against the resilient force of the spring 44. As shown in FIG. 5, when the latch 31 is rotated to a half-latched position, a pawl 34 of the ratchet 32 is engaged with a half-latched step 35 of the latch 31, thereby the back door 60 becomes a half-latched state. Further, as shown in FIG. 6, when the latch 31 is rotated to a full-latched position, the pawl 34 is engaged with a full-latched step 36 of the latch 31, thereby the back door 60 becomes a full-latched state.

An L-shaped latch lever 29 is pivotally mounted to the latch shaft 37 and is connected to the latch 31 by a connecting pin 39 so that they are rotated integrally. An arm 40 of the latch lever 29 substantially extends in a direction away from the opening portion 65, i.e., toward the outer panel 61, and a tip end of the arm 40 is projected beyond an exterior side of the housing 64. A contact pin or a roller 41 is provided at the tip end of the arm 40.

The latch assembly 7 has a switch 43 for detecting the half-latched state of the back door 60, i.e., the half-latched position of the latch 31. A movable contact 66 of the switch 43 is pressed against an end portion 42 of the latch lever 29 when the latch 31 is displaced from the door-opening position to the half-latched position. The switch 43 is electrically connected to the motorized closure assembly 63 so that the motorized closure assembly 63 is activated to rotate the latch 31 toward the full-latched position when the switch 43 detects the half-latched position of the latch 31. Therefore, even if the back door 60 is closed until only the half-latched state by manual closing operation, the back door 60 is subsequently completely closed by power of the motorized closure assembly 63.

The motorized closure assembly 63 will next be explained. A bracket 1 of the motorized closure assembly 63 is fixed to the inner panel 62 and is substantially parallel to the panels 61, 62. A electric motor 5 is fixed to an interior side surface of the bracket 1 and is substantially located on extension lines of axes of the latch and ratchet shafts 37, 38. An output gear 8 of the motor 5 is meshed with a gear portion 9 of an output member 2 which is pivotally mounted to a substantially central portion of an exterior side surface of the bracket 1 by a supporting shaft 22. A bent portion 13 of the output member 2 is inserted into an elongated arc hole 12 formed in the bracket 1, thus the output member 2 can be rotated by a range in which the bent portion 13 can be moved within the arc hole 12.

A rotating lever 4 is rotatably mounted to the supporting shaft 22 and is overlapped with the output member 2. A connecting link 3 is provided between the rotating lever 4 and the output member 2. At a central portion of the link 3 is formed an elongated hole 23 into which the shaft 22 is inserted, thereby the connecting link 3 can be slid in a radial direction of the shaft 22 by the clearance between the elongated hole 23 and the shaft 22. A pin 10 is attached to a first end portion 19 of the connecting link 3 and is projected from opposite sides of the connecting link 3. Rollers 20, 21 (see FIG. 1) are rotatably attached to both projecting sides of the pin 10, respectively. The output member 2, the connecting link 3 and the rotating lever 4 are arranged on the exterior side of the bracket 1.

The roller 21 of the connecting link 3 is engaged with a U-shaped groove 11 of the output member 2, and the other roller 20 of the connecting link 3 is engaged with an elongated hole 28 formed in the rotating lever 4. A spring 26 is arranged between a projection 24 of the rotating lever 4 and a projection 25 of the connecting link 3 so that the first end 19 of the connecting link 3 is biased toward the shaft 22, thereby the engagement between the roller 21 and the U-shaped groove 11 is maintained. The engagement between the roller 21 and the groove 11 is released when the connecting link 3 is slid against the resilient force of the spring 26.

When the roller 21 is engaged with the U-shaped groove 11 of the output member 2, the output member 2 is connected to the rotating lever 4 by the engagement of the roller 20 and the elongated hole 28. Accordingly, when the motor 5 is rotated, the rotating lever 4 is rotated clockwise in FIG. 2.

The roller 41 of the latch arm 40 is adapted to be located on a rotating locus of an end portion 27 of the rotating lever 4 when the latch 31 is located between the half-latched and full-latched positions. Accordingly, when the switch 43 detects the half-latched position of the latch 31 and the rotating lever 4 is rotated by power of the motor 5, the end portion 27 of the rotating lever 4 comes into contact with the roller 41 so as to rotate the latch arm 40 in the counterclockwise direction in FIG. 5. Thus, the latch 31 is displaced from the half-latched position to the full-latched position. At this time, since the latch arm 40 extends toward the outer panel 61, the distance between the roller 41 and the latch shaft 37 can be increased. Accordingly, the latch 31 can be displaced to the full-latched position by small torque of the the rotating lever 4. The distance between the roller 41 and the latch shaft 37 is desirably set to be longer than the distance between the latch shaft 37 and the opening portion 65. The rotating lever 4 is returned to its initial position by reversely rotating the motor 5 when the latch 31 becomes the full-latched position.

The motorized closure assembly 63 has a fail-safe lever 6 for cancelling closure of the back door 60 by power of the motor 5. The fail-safe lever 6 is approximately formed in a T-shape and is rotatably mounted to the bracket 1 by a shaft 47. A first arm 48 of the lever 6 is connected to an open handle 67 of the back door 60 through a rod 49. There is a case in which the open handle 67 is omitted in the back door 60. In this case, the first arm 48 is connected to a trunk lid opener, etc. having a function equal to that of the open handle 67.

An arc contact face 51 is formed on a lower face of a second arm 50 of the fail-safe lever 6. The distance between the contact face 51 and the supporting shaft 22 is ununiformly set. The distance between the shaft 22 and one end of the contact face 51 near to the shaft 47 is shortest, and the distance between the shaft 22 and the other end of the contact face 51 far away the shaft 47 is longest. The contact face 51 comes in contact with a pin 17 provided in a second end portion 16 of the connecting link 3 so as to slide the connecting link 3 against the resilient force of the spring 26 when the fail-safe lever 6 is rotated counterclockwise in FIG. 2 by an opening operation of the open handle 67 while the output member 2 is rotated. As a result, the roller 21 of the connecting link 3 is disengaged from the U-shaped groove 11 of the output member 2, and the connection between the output member 2 and the connecting link 3 is released. Accordingly, the closure of the back door 60 using the motor 5 can be stopped.

A third arm 52 of the fail-safe lever 6 extends toward the latch assembly 7 and is connected to a ratchet lever 54 which is supported to the bracket 1 by a pin 56. The ratchet lever 54 can be slid in a substantially horizontal direction when the lever 6 is rotated. A bent portion 68 formed at a tip end of the ratchet lever 54 extends downward and is engageable with an arm 53 of the ratchet 32. Similar to the latch arm 40, the ratchet arm 53 extends toward the outer panel 61. When the fail-safe lever 6 is rotated counterclockwise in FIG. 2 by the opening operation of the open handle 67, the ratchet lever 54 is slid rightward and the bent portion 68 comes into contact with the ratchet arm 53 so as to rotate the ratchet 32 in the clockwise direction in FIG. 6, thereby the latch 31 is released from the ratchet 32 and the door 60 is opened.

As mentioned above, in the present invention, the arm 40 of the latch 31 and the arm 53 of the ratchet 32 extend toward the exterior side of the back door 60. Therefore, the arms 40 and 53 can be formed to be very long in comparison with the conventional latch device without making the latch assembly 7 large-sized. Thus, the latch 31 and the ratchet 32 can be rotated by small force. Accordingly, the motorized closure assembly 63 for rotating the latch 31 can be made compact and manual force for operating the open handle 67 can be reduced. Further, since the motor 5 is substantially located above the latch and ratchet shafts 37, 38, the thickness of the latch device becomes thin.

What is claimed is:

1. A vehicle door latch device for use with a vehicle back door having an outer panel and an inner panel, said latch device comprising:

a latch assembly to be fixed to an end portion of the back door, said latch assembly including a housing which has an interior side opposed to the inner panel of the door and an exterior side opposed to the outer panel, a latch which is engageable with a striker fixed to a vehicle body and accommodated in the housing by a latch shaft, and a ratchet which holds an engagement between the latch and the striker by engaging with the latch and is accommodated in the housing by a ratchet shaft parallel to the latch shaft;

said latch being rotatable from a door-opening position to a full-latched position through a half-latched position against a resilient force of a first spring by engaging with the striker;

said housing having at the interior side thereof an opening portion into which the striker enters when the door is closed;

a motorized closure assembly attached to the latch assembly, said motorized closure assembly having an electric motor, an output member rotated by the electric motor, a rotating lever for displacing the latch from the half-latched position to the full-latched position when rotated, and a connecting member displaceable between a connecting position where rotation of the output member can be transmitted to the rotating lever and disconnecting position where the rotation of the output member cannot be transmitted to the rotating lever;

a switch for detecting the half-latched position of the latch and arranged for electrical connection to the motorized closure assembly so that the motor is operated to rotate the output member when the switch detects the half-latched position of the latch;

a second spring for biasing the connecting member toward the connecting position;

a fail-safe lever to be connected to an open handle of the back door and displacing the connecting member to the disconnecting position from the connecting position against the resilient force of the first spring when rotated;

said latch having a latch arm which substantially extends toward the outer panel of the door and overlaps with a rotating locus of the rotating lever when the latch is in the half-latched position;

said ratchet having a ratchet arm substantially extending toward the outer panel of the door when the ratchet is engaged with the latch; and a ratchet lever connected to the fail-safe lever and having an end portion which comes into contact with the ratchet arm to disengage the ratchet from the latch when the fail-safe lever is rotated.

2. The vehicle door latch device according to claim 1, wherein a distance between a tip end of the latch arm and the latch shaft is set to be longer than a distance between the latch shaft and the opening portion.

3. The vehicle door latch device according to claim 1, wherein said fail-safe lever has an elongated arm extending toward the latch assembly; and said ratchet lever is rotatably attached to said elongated arm and extends in a direction perpendicular to a longitudinal axis of the elongated arm.

4. The vehicle door latch device according to claim 3, wherein a distance between a tip end of the latch arm and the latch shaft is set to be longer than a distance between the latch shaft and the opening portion.

5. The vehicle door latch device according to claim 1, wherein said electric motor is arranged on extension line of the latch shaft.

6. The vehicle door latch device according to claim 5, wherein a distance between a tip end of the latch arm and the latch shaft is set to be longer than a distance between the latch shaft and the opening portion.

7. The vehicle door latch device according to claim 1, wherein said electric motor is arranged on extension line of the ratchet shaft.

8. The vehicle door latch device according to claim 7, wherein a distance between a tip end of the latch arm and the latch shaft is set to be longer than a distance between the latch shaft and the opening portion.

9. The vehicle door latch device according to claim 1, wherein an outer tip end of said latch arm projects beyond the exterior side of the housing.

10. The vehicle door latch device according to claim 1, wherein an outer tip end of said ratchet arm projects beyond the exterior side of the housing.

* * * * *